United States Patent [19]

Ehrfeld et al.

[11] Patent Number: 4,990,827

[45] Date of Patent: Feb. 5, 1991

[54] MICRO SECONDARY ELECTRON MULTIPLIER

[75] Inventors: Wolfgang Ehrfeld; Herbert Moser, both of Karlsruhe; Dietrich Münchmeyer, Stutensee, all of Fed. Rep. of Germany

[73] Assignee: Kernforschungszentrum Karlsruhe GmbH, Karlsruhe, Fed. Rep. of Germany

[21] Appl. No.: 169,607

[22] Filed: Mar. 17, 1988

[30] Foreign Application Priority Data

Mar. 17, 1987 [DE] Fed. Rep. of Germany ..... 3709298

[51] Int. Cl.[5] ..... H01J 43/18

[52] U.S. Cl. ..... 313/533; 313/103 R; 313/105 R

[58] Field of Search ..... 313/532, 533, 103 R, 313/104, 105 R, 534–536, 524, 528

[56] References Cited

U.S. PATENT DOCUMENTS

| | | | |
|---|---|---|---|
| 2,836,760 | 5/1958 | Winter | 313/103 |
| 2,868,994 | 1/1959 | Anderson | 313/536 X |
| 3,551,841 | 12/1970 | Harrick | 313/533 X |
| 3,932,762 | 11/1976 | Moser | 250/574 |
| 4,339,684 | 7/1982 | Kuroda et al. | 313/105 R |
| 4,482,836 | 11/1984 | Washington et al. | 313/104 |
| 4,649,314 | 3/1987 | Eschard | 313/103 R X |

FOREIGN PATENT DOCUMENTS

| | | | |
|---|---|---|---|
| 8415886 | 7/1984 | Fed. Rep. of Germany . | |
| 2338481 | 4/1985 | Fed. Rep. of Germany . | |
| 19445 | 11/1982 | Japan | 313/532 |
| 2040553 | 8/1980 | United Kingdom | 313/532 |

OTHER PUBLICATIONS

Hamamatsu, 12/1983 Catalog, pp. 22 and 23.

Joseph L. Wiza, "Microchannel Plate Detectors," Nuclear Instruments & Methods 162, (12–1979), pp. 587–601.

V. Jares et al, "A Flat Channel System for Imaging Purposes," Advances in Electronics and Electron Physics 33A, (12–1972), pp. 117–123.

F. Binon et al, "Hodoscope Multiphoton Spectrometer GAMS 2000," Nuclear Instruments & Methods in Physics Research A248, (12–1986), pp. 86–102.

E. W. Becker et al, "Herstellung von Mikrostrukturen mit grossem Aspektverhältnis und grosser Strukturhöhe durch Röntgentiefenlithographie mit Synchrotronstrahlung, Galvanoformung und Kunststoffabformung (LIGA-Verfahren)" KFK Report 3995 (12–1985), pp. 0–33.

*Primary Examiner*—Donald J. Yusko
*Assistant Examiner*—Michael Horabik
*Attorney, Agent, or Firm*—Spencer & Frank

[57] ABSTRACT

A micro secondary electron multiplier or an array thereof employs discrete dynodes which are microstructured and applied to an insulating substrate plate. The substrate plate is provided with electrical conductor paths for the connection of the dynodes. The dynodes can be made using a technique such as X-ray depth lithography-galvanoplasty (the LIGA technique). The micro secondary electron multiplier or an array of such multipliers is extremely small and sensitive, and has a high time resolution. Furthermore there is considerable flexibility in positioning the multipliers of an array.

27 Claims, 6 Drawing Sheets

MICRO SECONDARY ELECTRON MULTIPLIER

BACKGROUND OF THE INVENTION

The present invention relates to a secondary electron multiplier of the type which employs discrete dynodes, and to a method of producing such a secondary electron multiplier.

Such a secondary electron multiplier is known from inhouse publication SC-5 by Hamamatsu (1983 catalog) where it appears under the nomenclature R 1635. This device has eight stages and a diameter of 10 mm as well as a length of about 45 mm. These dimensions do not permit its use in miniaturized measuring systems.

Also known are micro-channel plates (see for example Joseph Ladislas Wiza, "Microchannel Plate Detectors," Nuclear Instruments and Methods 162, (1979) pages 587–601). Although micro-channel plates meet the requirement of compact size, they have a considerable dead time after a signal pulse so that their usability for very weak radiation and particle signals remains limited.

Also known are layered channel plates (see V. Jares et al, "A Flat Channel System for Imaging Purposes," Advances in Electronics and Electron Physics 33A, (1972), pages 117–123). Although layered channel plates avoid the drawback of long dead times, they exhibit considerable electron losses from stage to stage so that they again are unsuitable for use with extremely low radiation or particle signals. In other known layered channel plates (U.S. Pat. No. 4,482,836) such losses are reduced by shaping the channel walls by means of etching. But this type of shaping can be done only within narrow limits. Finally, arrays of secondary electron multipliers are known from high-energy physics (see F. Binon et al, "Hodoscope Multiphoton Spectrometer GAMS-2000," Nuclear Instruments and Methods in Physics Research, A248 (1986), pages 86–102). The great space requirement of such devices makes them entirely unsuitable for the construction of miniaturized measuring systems.

SUMMARY OF THE INVENTION

It is an object of the present invention to provide a micro secondary electron multiplier or an array of such multipliers which, compared to the prior art devices, require an extremely small amount of space and have a high time resolution, great sensitivity, and great flexibility as to the shape.

This and other objects which will become apparent in the ensuing detailed description can be attained by providing a secondary electron multiplier having discrete dynodes which are microstructured and disposed on an insulating substrate equipped with electrical conductor paths for connection of the dynodes. In this application the term "microstructured" means fabricated on a minute scale so as to provide dynodes which are extremely small, and multipliers which have maximum lengths of less than a centimeter. A secondary electron multiplier in accordance with the present invention is preferably made by applying conductor paths to an insulating substrate, producing dynodes on the conductor paths by X-ray depth lithography, X-ray depth lithography-galvanoplasty or by molding or molding-and-galvanoplasty derived therefrom, and if necessary connecting a cover plate with the dynodes, or applying a light-transmitting wall equipped with photocathodes and terminating with a cover plate.

The micro electron multipliers and arrays thereof used as sensors in miniaturized measuring systems for radiation or particles are distinguished, in an advantageous manner, by a small space requirement and high local and time resolution.

With the use of X-ray depth lithography and microgalvanics it is possible to construct an extremely small system of discrete dynodes whose shape has been selected in such a manner that the electrons are focused from one dynode to the next and thus electron losses are minimized. The sensitivity of the system is advantageously influenced thereby. Supplying voltage to the dynodes by way of discrete conductor paths makes it possible to adapt the external supply to the signal amplitude so that the dynamic range of the micro secondary electron multiplier becomes very large. The greatly reduced length of the secondary electron multiplier shortens the time it takes for the electrons to travel from cathode to anode, which has a favorable effect on the rise time of the pulses and thus on the realizable time resolution.

The production of such fine structures by X-ray depth lithography-galvanoplasty (LIGA technique) and by the molding technique derived therefrom is described and illustrated, inter alia, in E. W. Becker et al, "Herstellung von Mikrostrukturen mit grossen AspecKtverhältnis und grosser Strukturhöhe durch Röntgentiefenlithographie mit Synchrotronstrahlung Galvanoformung uynd Kunststoffabformung (LIGA-Verfahren)" ["Fabrication of Microstructures with High Aspect Ratios and Great Structural Heights by Synchrotron Radiation Lithography, Galvanoforming and Plastic Moulding (LIGA Method)"], KfK-Bericht [KFK Report] 3995, published by Kernforschungszentrum Karlsruhe (November, 1985) pages 0–33. According to this publication, for example, an X-ray sensitive positive resist material is applied to a metal base plate and is partially exposed to X-rays through a mask. Then the resist material is developed, resulting in a negative mold of the webs to be produced, with the height of the webs corresponding to the layer thickness of the positive resist material. Depending on the penetration depth of the X-ray radiation, this layer thickness may be up to 2 mm. Then the negative mold is galvanically (that is, by electroplating) filled with a metal, employing the base plate as the electrode, whereupon the remaining resist material is removed by means of a solvent. In the molding technique derived from the LIGA technique summarized above, a positive of the web structure to be produced is made using the LIGA technique and is employed as a re-usable tool from which plastic impressions are taken. The thus-produced negative mold is filled with metal by galvanic deposition and then the remaining plastic is removed. In both cases (that is, the LIGA technique itself or the molding technique derived from it), extremely accurate and fine structures can be produced with lateral dimensions in the μm range and a freely selectable height up to about 2 mm. With somewhat smaller heights, it is also possible to attain minimum lateral dimensions in the submicron range. A suitable radiation source for the LIGA technique is the X-ray radiation of an electron synchrotron or electron storage ring (synchrotron radiation).

In accordance with the invention it is possible to arrange a large number of micro secondary electron multipliers next to one another on the same base plate to provide a micro secondary electron multiplier array. This results in an extremely high packing density and thus favorably influences the spatial resolution which can be attained, an aspect which is of significance particularly for tomography and for detectors used in high energy physics.

In an array of micro secondary electron multipliers in accordance with the invention, the signal input ports of the multipliers of the array can be positioned so that they conform to given contours, for example to a Rowland circle, to a curved image surface, or to a cylinder as shown in the scattered light radiometer described below as an exemplary embodiment.

A further advantage is that one of the substrate plates can be provided with a light transmitting wall which is additionally provided with photocathodes serving as the signal input ports. Thus a micro secondary electron multiplier can be configured as a microphotomultiplier.

If the light transmitting wall is given a lens-shaped cross section and the photocathodes are applied to a separate substrate of light transmitting material, an optical image can be produced between the light source and the photocathode. This has a favorable influence on the definition of the scatter volume and on the signal-to-noise ratio.

DESCRIPTION OF THE PREFERRED EMBODIMENTS

Figure 1:
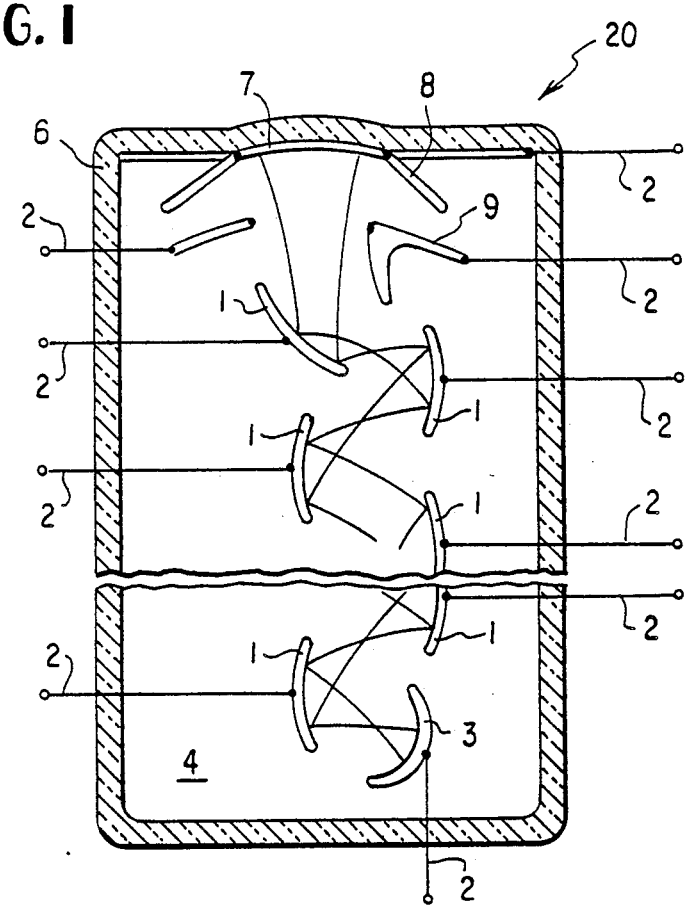
FIG. 1 is a top plan view of a micro secondary electron multiplier in accordance with the present invention.

The configuration of a micro secondary electron multiplier 20 in accordance with the present invention is shown schematically in FIG. 1. Reference number 1 identifies dynodes, reference number 2 identifies conductor paths to supply the dynodes with voltage, and reference number 3 identifies an anode. These structures are applied to a base plate 4. A glass wall 6 is provided by a second plate (which is not otherwise illustrated). A photocathode 7 is applied to wall 6 at a suitable location and serves as a signal input port, the signal of course being light. Further electrodes 8 and 9 serve to focus the photoelectrons emitted by the photocathode 7 on the first dynode 1. The base plate 4 and wall 6 are sealed together to form a vacuum-tight housing for the micro secondary electron multiplier 20. The multiplication requires electron energies in an order of magnitude of 100 eV. With a typical, safe operating value of 1 Kv/mm for the maximum electric field intensity at the surfaces of dynodes 1, the minimum spacing between dynodes 1 in the longitudinal direction (that is, the spacing between adjacent dynodes 1 in one of the two dynode columns shown in FIG. 1) becomes about 0.1 mm. For a multiplier 20 having 9 dynodes 1, each having an edge length of 1 mm, the total length of the multiplier 20 will be about 10 mm. Surface charges and resulting electrical sparkovers are avoided by the, albeit weak, conductivity of the surface layers on the walls of base plate 4 and the second plate (not illustrated except for wall 6).

Figure 2A:
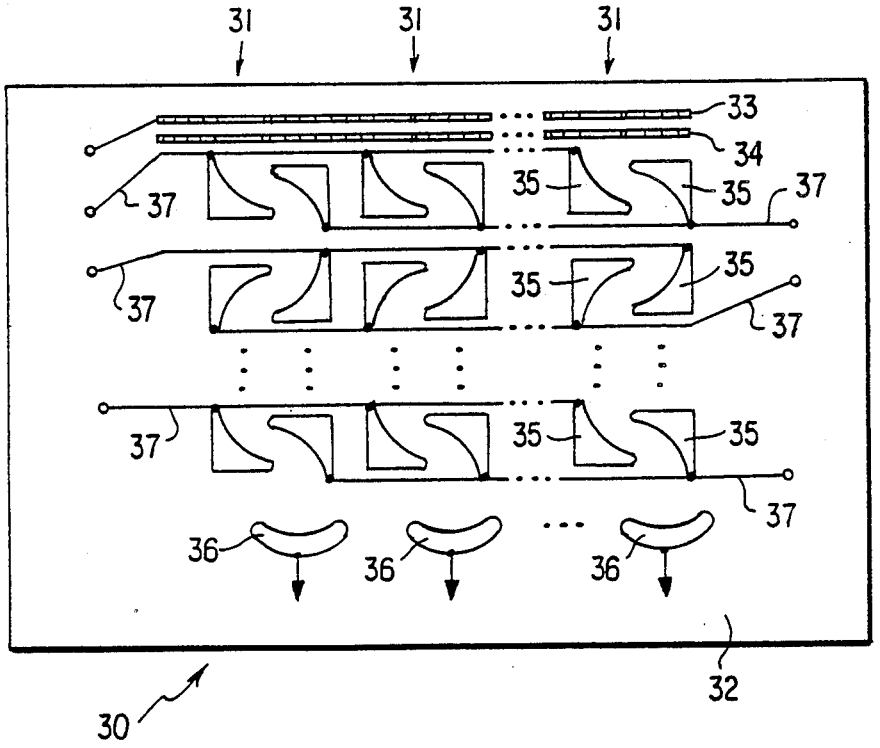
FIG. 2*a* is a top plan view of an array of micro secondary electron multipliers in accordance with another embodiment of the invention.

FIG. 2*a* schematically illustrates an array 30 of micro secondary electron multipliers 31. The multipliers 31 are fabricated on a base plate 32 which is disposed in a vacuum envelope (not illustrated). Array 30 includes an outer plate 33 and an inner plate 34 which are negatively biased with respect to the first dynodes 35. Plates 33 and 34 have openings (not numbered) which serve as signal input ports for the respective micro secondary electron multipliers 31. In this case the input signals are charged particles which reach dynodes 35 via the signal input ports. In each micro secondary electron multiplier 31 the dynodes 35 are arranged into columns as illustrated, and secondary electrons cascade back and forth between the columns until finally reaching the anode 36 of the respective multiplier 31. Conductor paths 37 fabricated on base plate 32 supply appropriate biasing potentials to the dynodes 35.

In FIG. 2*a* it will be apparent that the dots indicate the omission of components (e.g., dynodes 35 and anodes 36) or portions of elements (e.g., plates 33 and 34). It will also be apparent that the dynodes 35 of the entire array 30 are disposed in a matrix pattern, with each micro secondary electron multiplier 31 including the dynodes 35 in a pair of adjacent columns of the matrix. The use of a matrix pattern simplifies the task of supplying appropriate biasing voltages to the dynodes 35 in each of the micro secondary electron multipliers 31. As will be apparent, each conductive path 37 is electrically connected to alternate dynodes 35 in each row of the matrix, thereby providing a connection to one dynode 35 in each micro secondary electron multiplier 31.

Figure 2B:
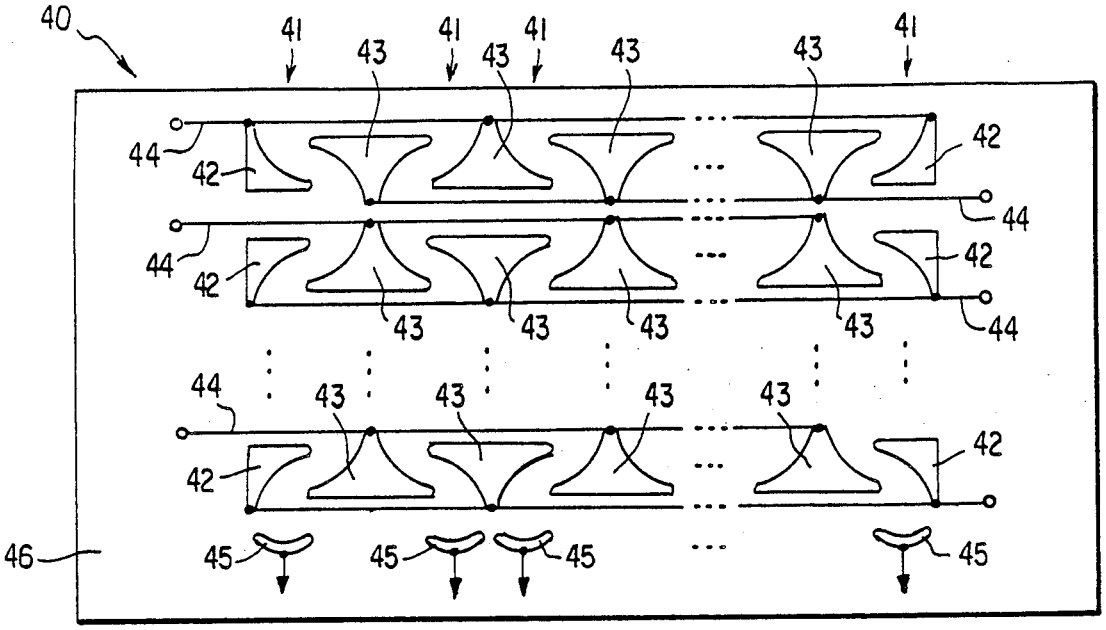
FIG. 2*b* is a top plan view of an alternate array of micro secondary electron multipliers in accordance with a further embodiment of the invention.

FIG. 2*b* schematically illustrates an array 40 of micro secondary electron multipliers 41 in accordance with a further embodiment of the invention devised to give a very compact structure of dynodes. In FIG. 2*b*, the end dynodes 42, interior dynodes 43, conductive paths 44, and anodes 45 are fabricated on a base plate 46, which is enclosed with a vacuum envelope (not illustrated). The input signals for array 40 are again charged particles, as was the case for array 30 (FIG. 2*a*). Outer and inner plates 33 and 34 (FIG. 2*a* ) are not illustrated.

In FIG. 2*b*, it will be apparent that dots are again used to indicate the omission of repetitive elements or to indicate the omission of portions of elements. Furthermore in FIG. 2*b* the dynodes are again positioned in a matrix pattern. However in FIG. 2*b* each interior dynode 43 is shared by a pair of micro secondary electron multipliers 41, which permits the array 40 to be very compact. It is only the end dynodes 42 which are used with a single micro secondary electron multiplier 41.

FIGS. 3*a* to 3*h* show an example of the production of a micro secondary electron multiplier or a multiplier array, with X-ray depth lithography using synchrotron radiation and galvano-shaping being employed as the most important process steps. A detailed description of these process steps can be found in an article by E. W. Becker, W. Ehrfeld, P. Hagmann, A. Maner and D. Münchmeyer, entitled "Fabrication of Microstructures With High Aspect Ratio and Great Structural Heights By Synchrotron Radiation Lithography, Galvanoforming and Plastic Moulding (LIGA Process)," published in Microelectronic Engineering 4 (1986) at pages 35–56. The description in this Microelectronic Engineering article corresponds generally to that provided by the aforesaid KFK Report by E. W. Becker et al, which was discussed in the "Summary of the Invention" portion of this application.

Figure 3A:
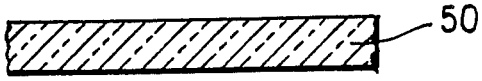
FIGS. 3*a* through 3*h* are sectional views illustrating a method for producing a micro secondary electron multiplier or an array of multipliers in accordance with the present invention.
Figure 3B:
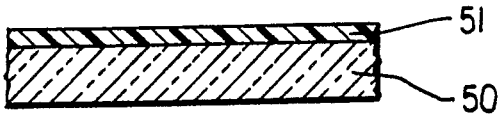
Figure 3C:
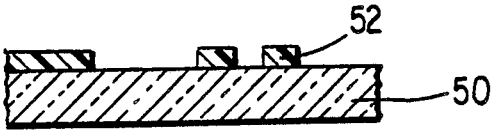
Figure 3D:
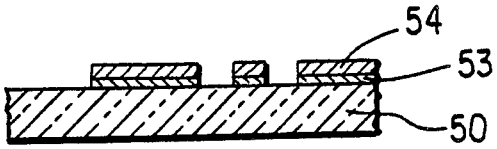
Figure 3E:
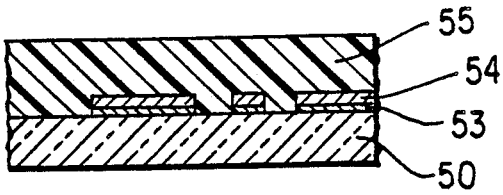
Figure 3F:
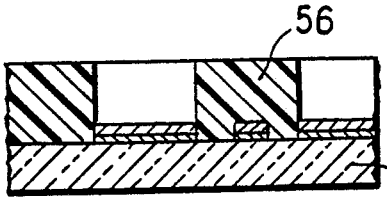
Figure 3G:
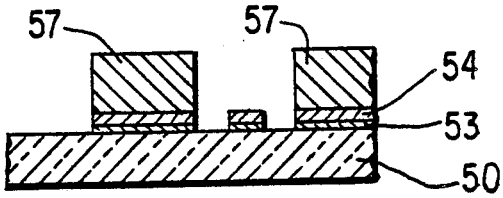
Figure 3H:
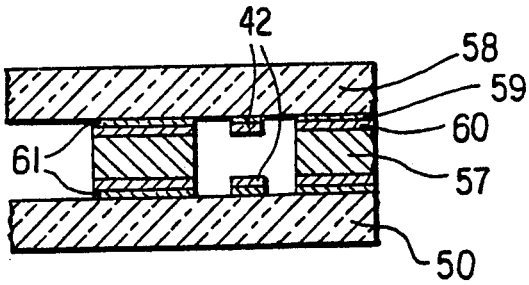

FIG. 3*a* shows a base plate 50 made of an aluminum oxide ceramic. The base plate 50 is about 1 mm thick, and its surface area is about 10 cm × 10 cm. Base plate 50 is coated by centrifuging on a thin layer 51 of a photoresist (e.g. AZ 1350 made by Kalle, Wiesbaden, Federal Republic of Germany) and is pretreated according to manufacturer's instructions (FIG. 3*b*). In a known manner, the photoresist is lithographically irradiated through a mask (not illustrated) and developed so that photoresist structures 52 result on base plate 50 (FIG. 3*c*). Then, a layer 53 of titanium having a thickness of 30 nm is initially applied over the entire surface area by means of a sputtering process and then a further layer 54 of nickel having a thickness of 200 nm is deposited. Then photoresist structures 52 are removed by immersion in an acetone bath, and this has the effect of also removing the regions of metal layers 53 and 54 that were disposed on top of photoresist structures 52. What remains is a metal layer structure 53, 54 on base plate 50 (FIG. 3*d*). As described in the above-cited article of Becker et al, a layer 55 of a polymethyl methacrylate casting substance (PMMA) is then applied to a thickness of 1 mm and polymerized. The layer 55 is next structured by mean of X-ray depth lithography with synchrotron radiation and subsequent developing to provide mold structures 56 (FIG. 3*f*). Nickel is then galvanically precipitated into the mold structures 56 of PMMA to constitute the dynodes 57 of the micro secondary electron multiplier. Thereafter, the PMMA mold structures 56 are removed in a solvent (FIG. 3*g*). In the same manner, other elements, such as, for example, anodes, shielding and the like are produced in the same process steps in parallel with dynodes 57 by providing the appropriate structures on the masks (not illustrated) employed in the lithography processes. A cover plate 58 having metal layer structures 59 and 60, which provide a mirror image of the structure shown in FIG. 3*d*, is produced in the manner described above with respect to FIGS. 3*a* to 3*d*. Where metal structures 60 are positioned to contact the dynodes 57, they are soldered to the dynodes 57 by diffusion soldering with silver, thus completing the fabrication process.

It will be apparent that the process described above with reference to FIGS. 3*a* through 3*h* can be used to make either the micro secondary electron multiplier 20 (FIG. 1) or arrays 30 or 40 (FIGS. 2*a* and 2*b* respectively) of multipliers. For example, if the process shown in FIGS. 3*a*–3*h* were employed to produce multiplier 20 (FIG. 1), the base plate 4 in FIG. 1 would correspond to the base plate 50 in FIG. 3*h*. The dynodes 1 in FIG. 1 would correspond to the dynodes 57 in FIG. 3*h*. As has been previously mentioned the anode 3 and focusing electrodes 8 and 9 in FIG. 1 can be fabricated in the same way. Conductor paths 2 in FIG. 1 are provided by conductor paths 61 in FIG. 3*h*, and vertical focussing can be provided by conductor paths 62. Photocathode 7 of FIG. 1 is formed on a wall (not illustrated) extending from cover plate 58 in FIG. 3*h*, the cover plate and the wall thereof (corresponding to wall 6 in FIG. 1) be made of glass.

Another method for producing the microstructures is the molding technique derived from the technique discussed above with respect to FIGS. 3*a* through 3*g*. Here a positive of the dynode structure to be produced by X-ray depth lithography with synchrotron radiation is used as a re-usable tool from which plastic impressions are taken. Then the resulting negative mold is filled with metal by galvanic deposition and the remaining plastic is removed. The base plate required to fix and contact the dynodes is placed into the tool during the molding process so that the plastic enters a firm bond with the base plate. The direct production of the microstructures by X-ray depth lithography with synchrotron radiation as well as the molding technique permit the production of extremely accurate structures having lateral dimensions in the μm range with freely selectable heights up to about 2 mm.

A multichannel scattered light radiometer will now be described with reference to FIG. 4. It is known that the scattering of light at small particles is an important aid in the examination of size and shape parameters in particle systems (M. Kerker, "The Scattering of Light," Academic Press, New York, 1969). One of the methods furnishing the most information is measuring the angular distribution of the scattered light. The simultaneous measuring of the scattered light under man different angles is particularly favorable for the signal-to-noise ratio, the measuring time required, and time resolution. The micro secondary electron multiplier arrays according to the invention permit the assembly of much smaller, more sensitive and more robust electronic multichannel detectors than corresponds to the prior art (German Patent No. 2,338,481, U.S. Pat. No. 3,932,762, German Utility Model Patent No. G 84/15886.7). Supplying the dynodes by way of the conductor paths permits the formation of groups of multichannel micro secondary electron multipliers which can be connected to different voltage supplies. In this way, it is possible to adapt the sensitivity of the system as a function of the scattering angle of the scattered light angle distribution. This means, for example, that in the case of highly forward-scattering particles, where the difference in intensity between forward and rearward may be several orders of magnitude, the rear detector region of about 90° to 180° be operated at maximum gain, the middle region of about 20° to 90° can be operated at average gain, and the front region of 0° to 20° can be operated just below the start of saturation effects.

Figure 4:
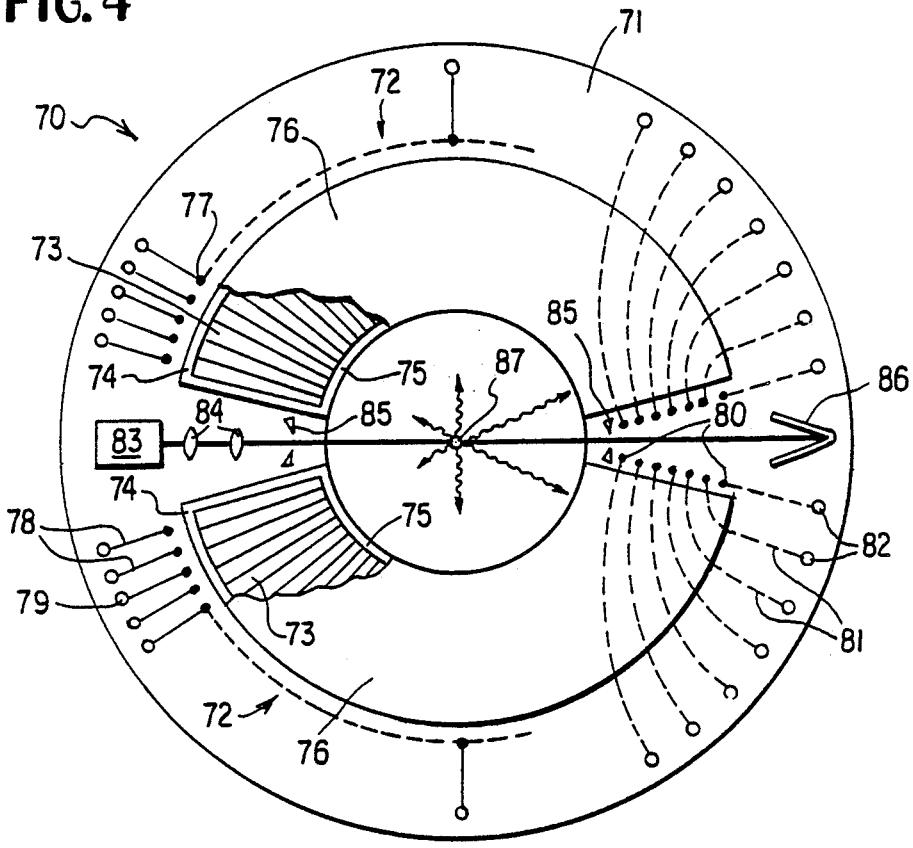
FIG. 4 is a top plan view, partially broken away, illustrating a multichannel scattered light radiometer which employs micro secondary electron arrays in accordance with the present invention.

In FIG. 4, a multichannel scattered light radiometer 70 includes an annular base plate 71 having a central opening (not numbered). The base plate 71 is provided with two sector-shaped arrays 72 of micro secondary electron multipliers 73. The signal input ports of the micro secondary electron multipliers 73 are here arranged on a circular arc and are oriented toward the center of opening in base plate 71. Each array 72 includes a glass wall 74 within which the respective micro secondary electron multipliers 73 are disposed. The inner arcs 75 of the glass walls 74 are provided with photocathodes (not illustrated), each photocathode providing the signal input port of an associated micro secondary electron multiplier 73.

Each glass wall 74 is terminated at the top by a cover plate 76 so that a vacuum-tight casing is produced around the arrays 72. The anodes (not illustrated of micro secondary electron multipliers are electrically connected by conductive paths (not illustrated) to terminals 77 affixed to base plate 71. By way of conductor paths 78, the signal outputs of the micro secondary electron multipliers 73 are brought to the outer edge of base plate 71 where contacts 79 are provided for external connection. The conductor paths (not illustrated) for supplying power to the dynodes (not illustrated) and focussing arrays (not illustrated) of arrays 72 are brought through metal-filled bores 80 to the underside of base plate 71 and from there by means of conductor paths 81 to external connections 82 at the outer edge of base plate 71.

A semiconductor laser 83, optical elements 84, apertures 85, and a wedge-shaped light sink 86 are arranged in the free sectors of base plate 71 in such a manner that a suitable beam path results for the scattering of light at density fluctuations of material disposed in the scatter volume 87. The material is retained in scatter volume 87 by a transparent tube (not illustrated) which extends through the central opening of base plate 71, or as a beam travelling through the central opening perpendicularly to the base plate 71.

The multichannel scattered light radiometer 70 shown in FIG. 4 makes it possible to test the symmetry of the scattered radiation with respect to the direction of the incident primary beam. This may be of considerable significance, for example for systems of non-symmetrical particles on which a certain orientation has been impressed by fluid dynamic or electromagnetic influences.

The flat configuration of such integrated measuring systems facilitates their use in several planes along a particle beam and thus the surveillance of the temporal evolution of the particle parameters. Moreover, it is well suited for use with a magnetic field to influence the electron paths. Although the cited exemplary embodiment refers to scattered light, the invention can also be used for scattering processes in which charged particles, such as electrons and ions, or excited neutrals are present and additionally also to radiation or particle sources which are self-emitting.

To give more details on the molding process mentioned about seven paragraphs ago, it should be noted that an internal release agent is used to facilitate the removal of the secondary plastic template from the metal mold. This release agent is supplied by Fa. Wuertz, Bingen, FRG, under the name PAT 665.

The sequence of steps used for producing the micro secondary electron multipliers by the molding process is displayed in FIG. 5(*a*) through 5(*h*). There steps (a) through (d) are applied once to produce the molding tool and steps (e) through (h) are the mass production steps performed many times. In close analogy to FIG. 3, FIG. 5(*a*) shows a base plate 90 made of a metal like an austenitic steel with a passivated surface 91. The base plate 90 is 3 to 10 mm thick. A layer 94 of a polymethyl methacrylate casting resin (PMMA) is applied on the base plate 90 to a thickness of about 1 mm. After polymerization, layer 94 is structured by means of X-ray depth lithography with synchrotron radiation and subsequent developing to provide mold structures 95 for the dynode structures to be formed (FIG. 5*b*). Nickel is then galvanically deposited into the mold structures 95, the base plate 90 serving as an electrode for galvanic deposition. Nickel deposition is continued over the resist thickness to produce a coherent nickel body 96. The nickel body 96 is released from the base plate 90 using the poor adhesion of nickel to the passivated surface 91. After stripping the PMMA resist 94 using a strong solvent and machining the rough surface 98 the molding tool 97 shown upside down in FIG. 5(*d*) is obtained.

Figure 5A:
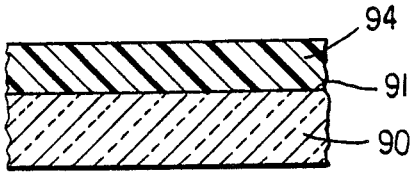
FIGS. 5*a* through 5*h* are sectional views illustrating the molding technique for producing a micro secondary electron multiplier or an array of multipliers in accordance with the present invention.
Figure 5B:
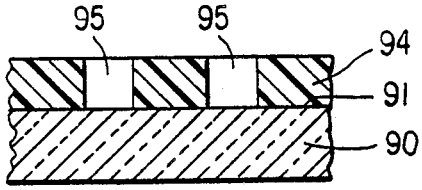
Figure 5C:
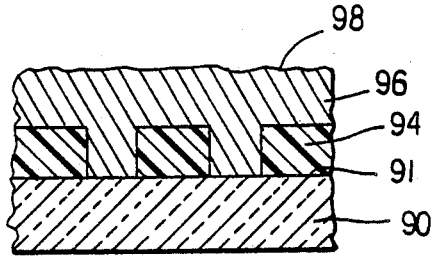
Figure 5D:
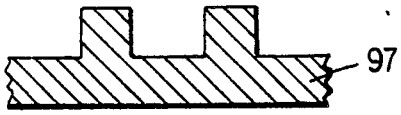
Figure 5E:
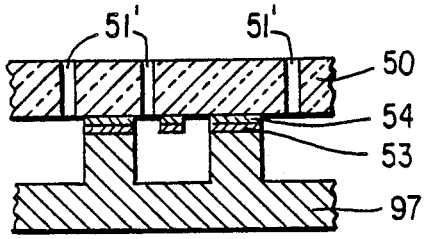
Figure 5F:
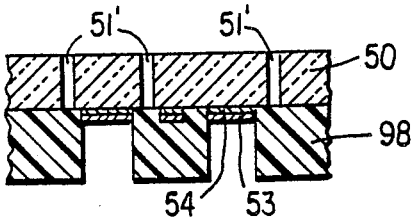
Figure 5G:
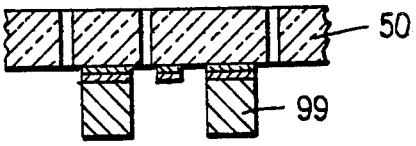
Figure 5H:
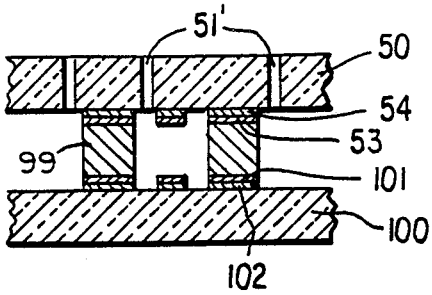

Now, a ceramic plate 50 with openings 51' and metal layers 53 and 54 is produced in the manner illustrated by steps (a) through (d) of FIG. 3 and put on top of the molding tool 97 (FIG. 5*e*). Then, a methacrylate-based casting resin 98 is filled through openings 51 into the empty space, and the molding tool 97 withdrawn (FIG. 5*f*). Again, nickel is galvanically deposited into the resin structures 98 to constitute the dynodes 99 of the micro secondary electron multiplier, and the resin structure 98 is removed in a solvent (FIG. 5*g*). In the same manner, other elements, such as, for example, anodes, shielding electrodes and the like are produced in the same process steps in parallel with dynodes 99 by providing the appropriate structures on the masks (not illustrated) employed in the lithography processes. Now, a cover plate 100 having metal layer structures 101 and 102, which provide a mirror image of the plate 50 shown in FIG. 5*e*, is produced according to steps (a) through (d) of FIG. 3. Cover plate 100 is brought in contact with the structure shown in FIG. 5*g*, and diffusion soldered at the places where dynodes 99 contact metal layers 102 (FIG. 5*h*).

Figure 6A:
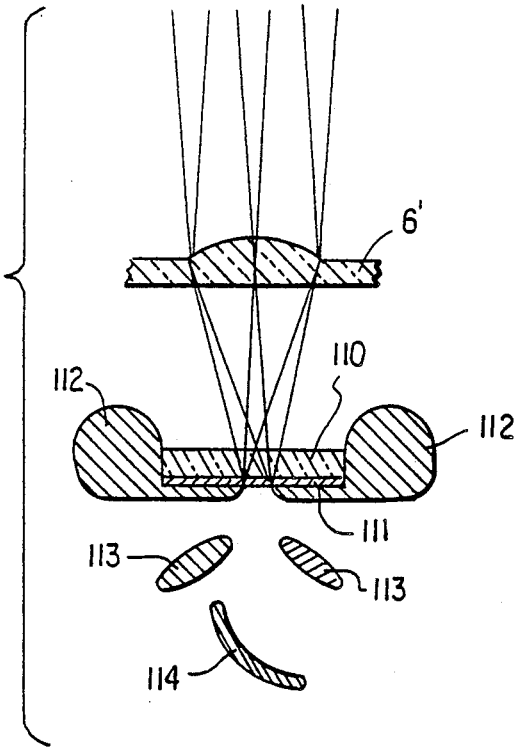
FIGS. 6*a* and 6*b* are top plan views illustrating the use of the light-transmitting wall to focus incoming light in accordance with the present invention.
Figure 6B:
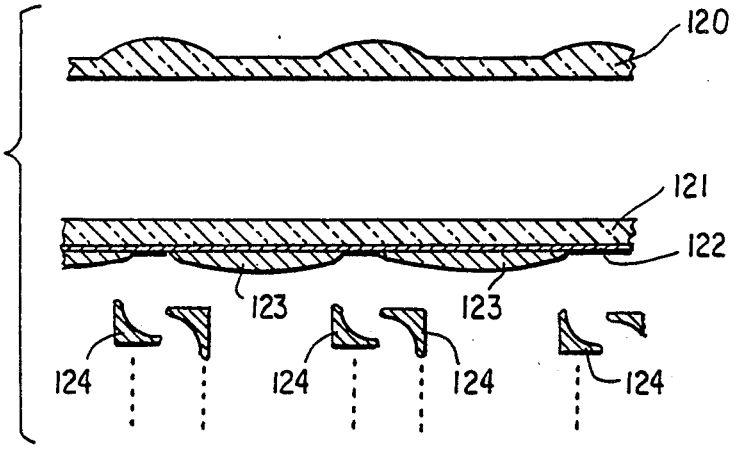

FIGS. 6*a* and 6*b* are top plan views illustrating the use of a light-transmitting wall to focuse the incoming light. FIG. 6*a* shows the front end of a micro photomultiplier. The light-transmitting wall 6' is partly lens-shaped. On the inner side of the wall 6' a light-transmitting slab 110 is disposed. On its rear side a thin layer 111 of a photoemitting material is deposited. Electrodes 112 limit the aperture where photoelectrons may leave and be accelerated by electrodes 113 to impinge on the first dynode 114. The remainder of the structure is analogous to FIG. 1.

FIG. 6*b* shows the front end of a micro photomultiplier array. The light-transmitting wall 120 has a number of lens-shaped bumps to focus incoming light. Behind the wall 120 a light-transmitting slab 121 is disposed. Its rear is covered with a thin layer 122 of a photoemissive material. Electrodes 123 limit the area from which electrons can leave the photoemissive layer 122 to regions in front of the entrance to the respective dynode structures 124. Only the two foremost dynodes of a group are shown. The photoemissive layer 121 and the electrodes 122 are held at the same electrical potential, which is negative with respect to the dynodes 124.

Figure 7:
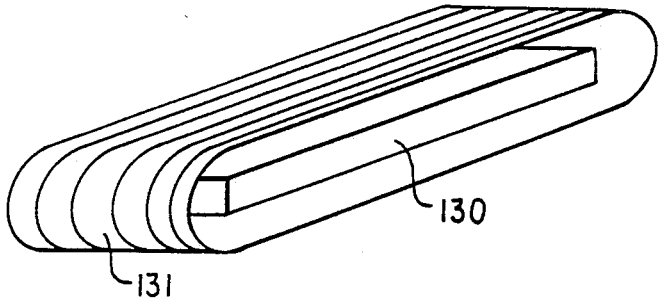
FIG. 7 illustrates the use of a magnetic field to guide the electrons inside the micro secondary electron multiplier or arrays of it in accordance with the present invention.

FIG. 7 shows schematically an array of micro secondary electron multipliers 130 surrounded by a coil 131 producing a weak magnetic field pointing along the longitudinal direction of the multipliers, which is also the direction of the incoming particles. The magnetic field serves to keep the electrons away from the base and the cover plates. The magnitude of the required field is of the order of 1 mT. In the same way, a single micro secondary electron multiplier or a micro photomultiplier could be disposed in a magnetic field.

Figure 8A:
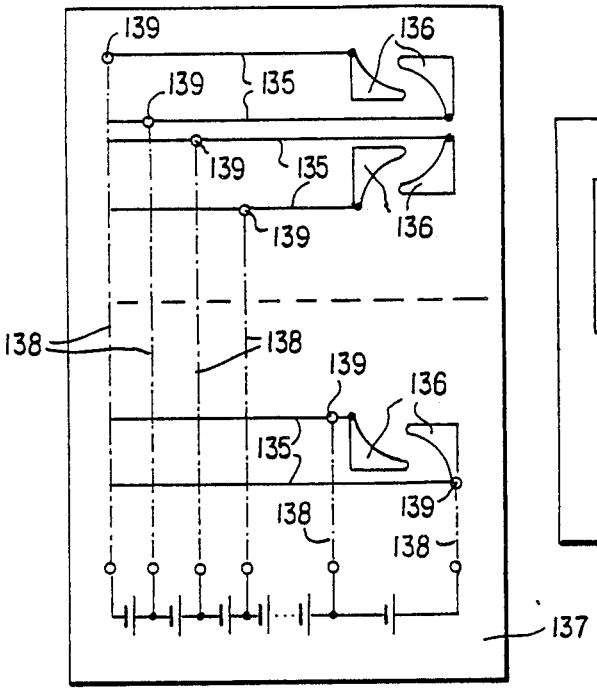
FIGS. 8*a* and 8*b* illustrate the connection of different groups of micro secondary electron multipliers to individual power supplies in accordance with the present invention.
Figure 8B:
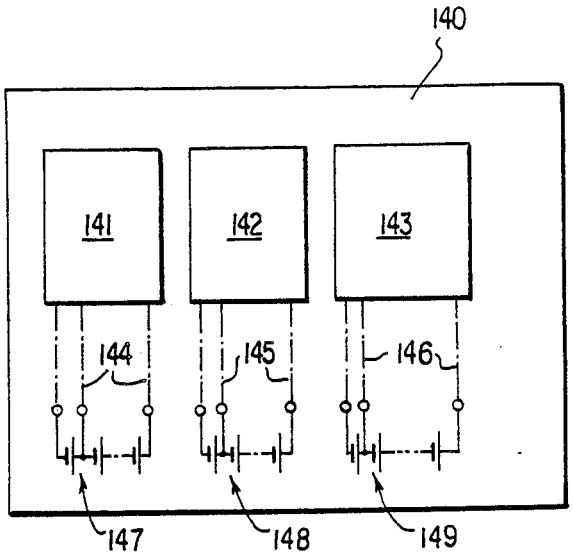

FIGS. 8*a* and 8*b* illustrate how groups of individual multipliers in an array can be connected to different power supplies. FIG. 8*a* shows that the conductive paths 135 supplying equivalent dynodes 136 on top of the insulating base plate 137 can be contacted by conductive paths 138 running perpendicularly to the conductive paths 135 at the opposite side of the base plate 137. Contact points 139 go through the insulating base plate 137. On an insulating base plate 140 three groups 141. 142. 149 are represented. (FIG. 8*b*). Each of them has conductive paths 144, 145, 146 equivalent to paths 138 which can be connected to different power supplies 147, 148, 149.

Figure 9A:
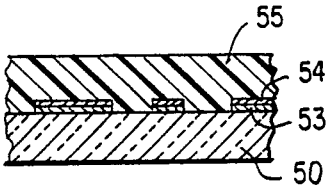
FIGS. 9*a* through 9*f* schematically show a process to form a surface layer having high secondary electron emission coefficient on the active surface of the dynodes in accordance with the present invention.
Figure 9D:
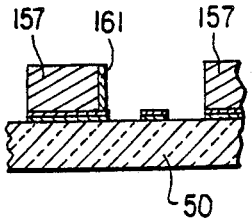
Figure 9B:
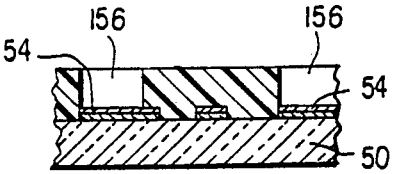
Figure 9E:
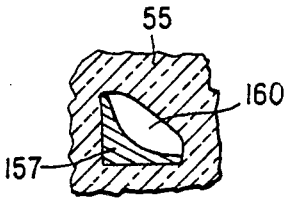
Figure 9C:
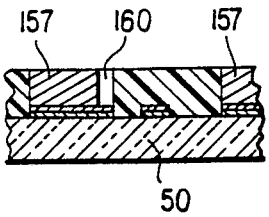
Figure 9F:
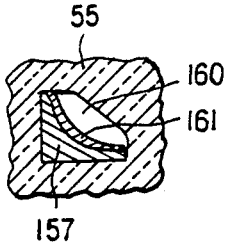

FIGS. 9*a* through 9*f* illustrate a procedure to form a surface layer of a material having a high secondary electron emission coefficient on the galvanically formed dynodes. The procedure starts with the situation as depicted in FIG. 3*e*. There an insulating substrate plate 50 equipped with conductive paths formed by metal layers 53 and 54 is covered with a thick layer 55 of PMMA (FIG. 5*a*). The PMMA layer 55 is then structured by means of X-ray lithography with synchrotron radiation and subsequent developing to provide the mold structures 156. It should be noted that this time the conductive path 54 serving as a base for the dynode to be formed is still partly covered by PMMA (FIG. 9*b*). Now, the dynodes 157 are formed by means of galvanoplasty, and then, by a further exposure-and-development step, gaps 160 are generated in front of the active surfaces of the dynodes 157. This is illustrated in FIG. 9*c* in a sectional view and in FIG. 9*e* in a top plan view. Now, a layer 161 of a material with a high secondary electron emission coefficient such as Be, GaAs or the like is deposited by a physical vapor deposition process, and the remaining PMMA 55 is removed (FIG. 9*d* is a sectional view, and FIG. 9*f* is a top plan view).

The present disclosure relates to the subject matter disclosed in Federal Republic of Germany application P 37 09 298.7 of Mar. 17th, 1987, the entire disclosure of which is incorporated herein by reference.

It will be understood that the above description of the present invention is susceptible to various modifications, changes and adaptations, and the same are intended to be comprehended within the meaning and range of equivalents of the appended claims.

What we claim is:

1. A secondary electron multiplier, comprising:

an insulating substrate plate having a surface;

a plurality of discrete dynodes attached to the surface of the substrate plate, each dynode including at least a first layer of a first metal and a second layer of a second metal this is different from the first metal, with the first and second layers being disposed at different distances from the surface of the substrate plate; and electrical conductor paths attached to the substrate plate, the electrical conductor paths being connected to the dynodes.

2. The secondary electron multiplier of claim 1, further comprising another insulating plate having a surface, the surfaces of the insulating plate and the another insulating plate being spaced apart and substantially parallel, and wherein the dynodes contact the surfaces of both the insulating plate and the another insulating plate.

3. The secondary electron multiplier of claim 2, wherein the dynodes are microstructured and disposed in an elongated pattern on the substrate plate, the pattern of dynodes having a length which is less than one centimeter.

4. The secondary electron multiplier of claim 2, further comprising additional conductor paths to vertically focus electrons, the additional conductor paths being disposed on at least one of the plates.

5. The secondary electron multiplier of claim 2, wherein the total number of dynodes is divided into two not necessarily equal parts, and wherein the first part of the dynodes is disposed on the insulating substrate plate and the second part of the dynodes is disposed on the another insulating plate.

6. The secondary electron multiplier of claim 2, further comprising a wall having a light-transmitting portion, the wall being secured to the plates to provide a vacuum-tight housing for the dynodes, and a photocathode exposed to the light-transmitting portion of the wall.

7. The secondary electron multiplier of claim 6, wherein the light-transmitting portion of the wall is lens-shaped, and further comprising a light-transmitting carrier to which the photocathode is applied, the light-transmitting carrier being positioned with respect to the light-transmitting portion of the wall so that an imaging relationship exists between a light source and the photocathode.

8. The secondary electron multiplier of claim 2, further comprising means disposed outside the plates for generating a magnetic field to guide the electrons.

9. The secondary electron multiplier of claim 3, wherein each dynode is spaced apart from an adjacent dynode by about a tenth of a millimeter.

10. The secondary electron multiplier of claim 2, further comprising a wall having a lens integrally formed therein, the wall being secured to the plates to provide a vacuum-tight housing for the dynodes, a light-transmitting carrier that is spaced apart from the wall by an empty gap and that is disposed between the lens and the dynodes, the carrier having a front side that is oriented toward the lens and a rear side that is oriented toward the dynodes, and a photocathode on the rear side of the carrier.

11. The secondary electron multiplier of claim 10, further comprising a pair of electrodes contacting the photocathode, the electrodes being spaced apart by a gap that is oriented toward the dynodes.

12. An array of secondary electron multipliers, comprising:

an insulating substrate plate having a surface;

a plurality of dynode groups, each dynode group including a respective plurality of discrete dynodes which are attached to the surface of the substrate plate, each dynode including at least a first layer of a first metal and a second layer of a second metal that is different from the first metal, with the first and second layers being disposed at different distances from the surface of the substrate plate;

electrical conductor paths attached to the substrate plate, each electrical conductor path being connected to at least one dynode;

means for defining a separate signal input port for each dynode group; and means for defining a separate signal output port for each dynode group.

13. The array of claim 12, further comprising another insulating plate having a surface, the surfaces of the insulating plate and the another insulating plate being spaced apart and substantially parallel, and wherein the dynodes contact the surfaces of both the insulating plate and the another insulating plate.

14. The array of claim 13, wherein the dynodes of each dynode group are microstructured and disposed in an elongated pattern on the substrate plate, the pattern of dynodes in each dynode group having a length which is less than one centimeter.

15. The array of claim 13, further comprising additional conductor paths to vertically focus electrons, the additional conductor paths being disposed on at least one of the plates.

16. The array of claim 13, wherein the total number of dynodes is divided into two not necessarily equal parts, and wherein the first part of the dynodes is disposed on the insulating substrate plate and the second part of the dynodes is disposed on the another insulating plate.

17. The array of claim 13, further comprising a wall having a plurality of light-transmitting locations, the wall being secured to the plates to provide a vacuum-tight housing for the dynodes, and wherein the means for defining a separate signal input port for each dynode group comprises a plurality of photocathodes, each photocathode being exposed to a respective light-transmitting location.

18. The array of claim 17, wherein the light-transmitting locations of the wall are lens-shaped, and wherein the means for defining a separate signal input port for each dynode group further comprises a plurality of light-transmitting carriers to which the photocathodes are applied, each light-transmitting carrier being positioned with respect to a respective light-transmitting location of the wall so than an imaging relationship exists between a light source and the respective photocathode.

19. The array of claim 13, further comprising means disposed outside the plates for generating a magnetic field to guide the electrons.

20. The array of claim 12, wherein the signal input ports are disposed along a curved line.

21. The array of claim 12, wherein some of the dynodes are common dynodes which are shared by adjacent dynode groups.

22. The array of claim 12, wherein the dynode groups are arranged in a plurality of sets, the sets of dynode groups being connected to different voltage supplies.

23. The array of claim 14, wherein each dynode of a group is spaced apart from an adjacent dynode of the respective group by about a tenth of a millimeter.

24. The array of claim 14, wherein the means for defining a separate signal input port for each dynode group comprises a flat plate having a plurality of apertures that are disposed along a straight line that is parallel to the substrate plate so that the axis of an incident beam of light is perpendicular to the straight line and coincidentally parallel the substrate plate itself, each of the apertures providing a signal input port for a respective one of the dynode groups.

25. The array of claim 14, wherein the means for defining a separate signal input port for each dynode group comprises means for defining signal input ports that are disposed along a curved arc.

26. The array of claim 13, further comprising a wall having a plurality of lenses integrally formed therein, the wall being secured to the plates to provide a vacuum tight housing for the dynode groups, and wherein the means for defining a separate signal input port for each dynode group comprises a light-transmitting carrier that is spaced apart from the wall by an empty gap and that is disposed between the lenses and the dynode groups, the wall having a front side that is oriented toward the lenses and a rear side that is oriented toward the dynode groups, and a photocathode on the rear side of the carrier.

27. The array of claim 26, wherein the means for defining a separate signal input port for each dynode group further comprises a plurality of electrodes contacting the photocathode, each pair of adjacent electrodes being spaced apart by a gap that is oriented toward a respective dynode group.

* * * * *